US006024633A

United States Patent [19]

Kimura et al.

[11] Patent Number: 6,024,633

[45] Date of Patent: Feb. 15, 2000

[54] WORKPIECE HOLDING DEVICE AND POLISHING APPARATUS THEREWITH

[75] Inventors: Norio Kimura, Fujisawa; Toshiya Takeuchi, Tokyo, both of Japan

[73] Assignee: Ebara Corporation, Tokyo, Japan

[21] Appl. No.: 09/018,459

[22] Filed: Feb. 4, 1998

[30] Foreign Application Priority Data

| | | | |
|---|---|---|---|
| Feb. 4, 1997 | [JP] | Japan | 9-035510 |
| Feb. 4, 1997 | [JP] | Japan | 9-035511 |
| Apr. 21, 1997 | [JP] | Japan | 9-117535 |

[51] Int. Cl.[7] ..... B24B 29/00

[52] U.S. Cl. ..... 451/288; 451/398; 451/388

[58] Field of Search ..... 451/289, 288, 451/286, 287, 290, 388, 398

[56] References Cited

U.S. PATENT DOCUMENTS

| | | | |
|---|---|---|---|
| 4,194,324 | 3/1980 | Bonora et al. . | |
| 4,270,314 | 6/1981 | Cesna | 51/131.4 |
| 4,373,991 | 2/1983 | Banks | 156/645 |
| 5,423,558 | 6/1995 | Koeth et al. . | |
| 5,441,444 | 8/1995 | Nakajima . | |
| 5,476,414 | 12/1995 | Hirose et al. . | |
| 5,651,724 | 7/1997 | Kimura et al. | 451/41 |
| 5,670,011 | 9/1997 | Togawa et al. | 156/345 |
| 5,839,947 | 11/1998 | Kimura et al. | 451/288 |

*Primary Examiner*—Timothy V. Eley
*Assistant Examiner*—Dung Van Nguyen
*Attorney, Agent, or Firm*—Weneroth, Lind & Ponack, L.L.P.

[57] ABSTRACT

A workpiece holding device enables stable polishing to be performed without sacrificing the structural strength of a top ring or the space necessary for machining a through hole or implanting engaging pins while allowing close contact to be made between a workpiece to a polishing cloth on a polishing tool. The top ring includes a top ring member having a holder plate for holding the workpiece on a front surface and a cover plate attached to a back surface of the holder plate by engaging a depression section formed on a back surface of the holder plate with a protrusion section formed on a front surface of the cover plate. A curved surface bearing unit provided between an end portion of a drive shaft and a back surface of the cover plate couples the drive shaft and the top ring member while permitting motion of the top ring member relative to the polishing tool. At least a portion of the curved surface bearing unit is positioned within the depression section.

22 Claims, 6 Drawing Sheets

WORKPIECE HOLDING DEVICE AND POLISHING APPARATUS THEREWITH

BACKGROUND OF THE INVENTION

1. Field of the Invention

The present invention relates to a workpiece holding device preferably for use in a polishing apparatus for producing a flat mirror surface on a workpiece such as a semiconductor wafer.

2. Description of the Prior Art

In recent years, there has been a remarkable progress in the density of integrated circuit devices leading to a trend of narrowing interline spacing, and, in the case of using optical lithography process involving less than 0.5 $\mu$m line spacing particularly, the shallow depth of focus is associated to demand that the focusing plane of the stepper device be highly flat. It then becomes necessary to provide a very flat surface on semiconductor wafer, and one such method is to carry out the planarization using a polishing apparatus.

FIG. 5 shows a conventional polishing apparatus 130 having a turntable 132 with a polishing cloth 131 mounted on its top surface and a top ring 133 for holding a wafer W and pressing it onto the turntable 132. Polishing is performed by rotating the turntable 132 and the top ring 133 independently while supplying a polishing solution Q from a supply nozzle 134 on the polishing cloth so as to remove the surface material chemically as well as mechanically.

As shown in FIGS. 6 and 7, for example, the top ring 133 may be a top ring member 100, disclosed in Japanese Laid-open Patent Publication H6-198561, coupled to a pressing device and a driving device through a drive shaft 102 (spline shaft). A flange section 104 is provided at the lower end of the drive shaft 102 to extend laterally, and a number of radially extending drive pins 106 are provided on the side surface of the flange section 104. On the top surface of the top ring member 100, a corresponding number of vertically extending engaging pins 108 are provided so that the rotation of the drive shaft 102 engages the drive pins 106 with the engaging pins 108 to transmit the drive force from the drive shaft 102 to the top ring member 100.

Also, cavities 110, 112 each having a spherical inner surface, are provided respectively on the bottom end of the drive shaft 102 and on the top surface of the top ring member 100, so that a wear resistant ball 114 can be placed to form a spherical bearing device 116. This spherical bearing device 116 ensures that, even if the turntable becomes tilted with respect to the drive shaft 102, the top ring member 100 is able to follow such tilt to maintain a close contact between the workpiece and the turntable.

The polishing apparatus of such a construction performs polishing of the workpiece W, by pressing the workpiece W onto the turntable through the top ring member 100 with a certain pressing force while the top ring and the turntable are being rotated to produce a flat and mirror polished surface.

A through hole 118 is provided in the center section of the drive shaft 102, and the top section of the through hole 118 is connected to an external device such as a fluid supply device or suction device, and the bottom section of the through hole 118 is connected to one end of a tube 120 to communicate with the space or region between the top ring member 100 and the workpiece W to be polished. Various operations are performed through the tube 120, such as handling of a fluid between the external device and the polishing apparatus, vacuum holding of the wafer W on the top ring member 100 or pressing of the wafer W onto the turntable by providing a high pressure fluid during the polishing operation.

In such a conventional polishing apparatus, because the pressing force of the drive shaft 102 is designed to be transmitted through the spherical bearing 116 provided between the drive shaft 102 and the top ring member 100, a close contact of the wafer W to the turntable surface can be achieved. At the same time, however, because of the frictional forces acting between the wafer W and the polishing cloth on the turntable, the top ring member 100 is subjected to a turning moment which tends to rotate the structure 100 about the spherical bearing 116, and, depending on polishing conditions, stable polishing might not be performed.

The turning moment is proportional to the radial distance between the center of the bearing 116 and the polishing surface of the wafer W. Therefore, polishing can be made more stable, for example, by making the top ring member 100 thinner to reduce the turning moment. However, such an approach presents a problem of possible distortion of the top ring member 100 due to lowering of the stiffness thereof, as well as other problems related to shortage of space for fabricating a connection hole 122 between the tube and the inner space of the top ring member 100 or embedding the drive pins 108 in the top ring member 100, resulting in difficulties in such fabrications or reduction of the structural strength of the top ring.

Also, because the pressing force by the drive shaft 102 is transmitted through the spherical bearing 116 in the conventional polishing apparatus, the wafer W can be pressed closely against the turntable surface. However, even though the arrangement allows a high degree of freedom for tilting, because only one drive pin on the top ring side engages with one engaging pin on the drive shaft side, if the rotation of the top ring becomes unstable for any reason, the contact between the two pins becomes erratic and the transmission of rotating force becomes unstable so as to compound the rotational instability of the top ring.

Furthermore, the conventional polishing apparatus has a metallic drive shaft 102 with through hole 118 in its center section. If there are pin holes in the inner surface of the through hole 118, application of an anti-rusting coating on the surface of the through hole 118 does not provide sufficient coverage to prevent rust formation. In such a case, pure water directed to the wafer through the through hole 118, into the space between the top ring member 100 and the wafer W, becomes contaminated with rust substances, causing a danger of degrading the properties of the wafer product.

SUMMARY OF THE INVENTION

It is a first object of the present invention to provide a workpiece holding device to enable stable polishing to be performed without sacrificing the structural strength of a top ring or the space necessary for machining through hole or implanting a engaging pins while allowing a close contact to be made between the workpiece and a polishing cloth on a turntable.

The first object has been achieved in a workpiece holding device comprising: a top ring member comprising a holder plate for holding the workpiece on a front surface, and a cover plate attached to a back surface of the holder plate by engaging a depression section formed on a back surface of the holder plate with a protrusion section formed on a front surface of the cover plate; a drive shaft for supporting the top ring member while permitting transmission of a pressing force to the top ring member; and a curved surface bearing unit provided between an end portion of the drive shaft and a back surface of the cover plate for coupling the drive shaft and the top ring member while permitting a tilting motion of the top ring member relative to the turntable, wherein at least a portion of the curved surface bearing unit is positioned within the depression section.

In the present polishing apparatus, the curved surface bearing unit is disposed closer to the turntable, by designing the top ring to be thinner by having a depression section on the cover plate side, and positioning at least a portion of the bearing unit within the depression section. Therefore, the turning moment exerted by the turntable on the workpiece is reduced to stabilize the attitude of the workpiece. Further, the depression section of the holder plate and the protrusion section in the cover plate mate together so that stiffness of the top ring is not compromised. The present workpiece holder device thus makes it possible to carry out stable polishing of a workpiece without sacrificing any of the important factors such as: maintaining the material requirements for making flow holes and other parts in the top ring and close contact between the polishing cloth and the workpiece. The curved surface bearing unit is usually a spherical bearing, but other bearing configurations can be adopted depending on the conditions.

In the above polishing apparatus, another depressed area may be formed on a back surface of the cover plate, and another protruded area may be formed on the bottom end of the drive shaft for inserting into the depressed area, so that the curved surface bearing unit is included between the depressed area and the protruded area. This arrangement allows a reduction in the thickness in the center region, thereby further improving the stabilizing effect.

A second object is to provide a workpiece holding device to enable stable polishing to be carried out by reliably transmitting the drive force from the drive shaft to the top ring while retaining the freedom of tilting motion between the top ring and the drive shaft.

The second object has been achieved in a workpiece holding device comprising: a top ring member for holding a workpiece; a drive shaft for supporting the top ring member so as to freely enable tilting of the top ring member by way of a curved surface bearing unit; and a force transmission mechanism disposed between a bottom end of the drive shaft and the top ring member for transmitting a rotational force from the drive shaft to the top ring member, wherein the force transmission mechanism includes a drive member extending in a given direction from a drive shaft side, and a driven member extending from a top ring member side to an engaging location to engage with the drive member when the drive shaft is rotated, and wherein at least one of the drive member and the driven member is arranged to contact the other member from opposite sides in a circumferential direction so as to restrict a relative circumferential movement of the top ring member with respect to the drive shaft.

This configuration allows reliable transmission of drive force from the drive shaft to the top ring member without disengaging the contact between the drive member and the driven member. The dimensions, shape and orientation of the drive and driven members may be changed in various ways, but generally, pin shapes are used. It is preferable that the material of construction be sufficiently stiff to enable reliable force transmission while allowing free tilting movement by some elastic deformation.

These members are preferably engaged in a crossing manner. Usually, the drive member extends radially outwards, and the driven member extends upwards from the top surface of the top ring. One set of drive and driven members is sufficient, but two or more number of sets of members may be distributed equidistantly around the circumferential periphery to improve transmission stability.

The drive member and the driven member may be in point contact with each ridge line. In this case, the degree of freedom of tilting motion can be enhanced, and especially, tilting in the vertical direction of the drive shaft and twisting including circumferential displacement may be accommodated to some degree.

The drive member and the driven member may be in contact through an elastic cushioning member. In this case, the degree of freedom of tilting movement is retained and vibrations can be absorbed by elastic deformation of the cushioning member to stabilize the workpiece holding capacity of the top ring member.

One member may be embedded into a hole provided for loosely fitting the other member therein. In so doing, these members do not extend out of the apparatus to interfere, and positioning and construction of the other member are simplified, and the production cost of the polishing apparatus can be lowered.

It is a third object of the present invention to provide a workpiece holding device that enables clean water to be delivered therethrough so as to prevent contamination of the workpiece.

The third object has been achieved in a workpiece holding device comprising: a top ring member for holding a workpiece; a drive shaft for supporting the top ring member so as to freely enable tilting of the top ring member by way of a curved surface bearing unit; and a force transmission mechanism disposed between an end portion of the drive shaft and the top ring member for transmitting a rotational force from the drive shaft to the top ring member, wherein a through hole is formed in a central region of the drive shaft, and a fluid tube is inserted into the through hole in such a way that one end of the fluid tube is communicated with an external device including a fluid supply source and an opposite end of the fluid tube is communicated with a space formed between the top ring member and the workpiece.

According to the workpiece holding device, a through hole is provided through the center section of the drive shaft and a fluid tube made of a suitable material, different than the drive shaft material, is provided within the through hole, and pure water is delivered through the fluid tube to the space between the top ring and the workpiece or substrate so that mixing of rust in the water is prevented, and contamination of the workpiece is prevented, thereby improving the physical precision of polishing as well as its quality of chemical purity.

In the above device, the fluid tube may be made of a corrosion resistant and flexible material.

DESCRIPTION OF THE PREFERRED EMBODIMENT

Figure 1:
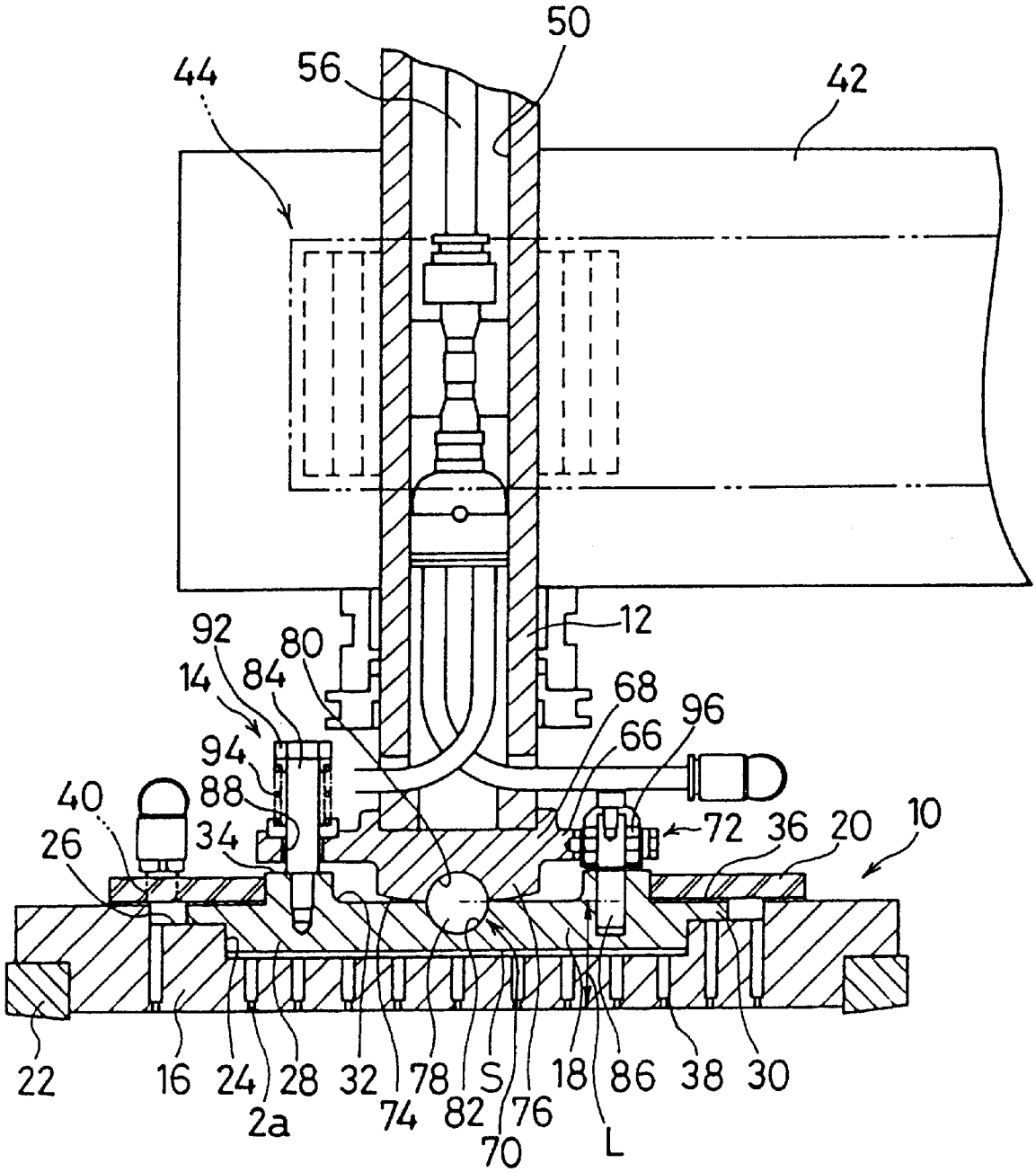
FIG. 1 is a cross sectional view of an embodiment of the polishing apparatus of the present invention.

A preferred embodiment of the workpiece holding device for use in a polishing apparatus will be presented in the following with reference to FIGS. 1 to 4. The workpiece holding device comprises a top ring member 10 of an overall disc shape, a drive shaft 12 for supporting the top ring member 10 and transmitting rotational and pressing forces to the top ring member 10, and a universal joint 14 joining the drive shaft 12 to the top ring member 10 in such a way as to accommodate tilting motion of the top ring member 10 relative to the drive shaft 12. In the following presentation, horizontal surfaces of various component parts are referenced such that a lower surface closer to the workpiece is the front surface and an upper surface away from the workpiece is the back surface. Upper and lower surfaces thus correspond to back and front surfaces, respectively.

Each of these sections will be explained in more detail in the following.

In this embodiment, the top ring member 10 comprises a holder plate 16 of a generally disc shape for holding a workpiece such as a wafer by means of a suction force, a cover plate 18 of a generally disc shape fixed to the holder plate 16 so as to form a space S on the upper side of the holder plate 16, and a fixing plate 20 of a hollow disc shape for covering the cover plate 18 and fixing the same to the holder plate 16. A guide ring 22 is attached to the lower outer periphery of the holder plate 16 for surrounding the outer periphery of the workpiece when the holder plate 16 holds the wafer on its lower surface.

A depression or depression section 24 is formed in the upper surface (back surface in relation to the front surface which holds the workpiece) of the holder plate 16 and a step surface 26 is formed around the outer periphery of the holder plate 16. On the other hand, a protrusion or protrusion section 28 for fitting into the depression section 24 is formed in the center region of the front surface of the cover plate 18, and a thin flange or flange section 30, to be fixed to the step surface 26 with bolts, is provided around the periphery or peripheral section of the cover plate 18. The upper (back) surface of the cover plate 18 has a central depressed area 32 and a ring shaped shoulder or shoulder section 34 surrounding its periphery, and an outer region forms a step surface 36 for attaching the fixing plate 20.

The depth of the depression section 24 in the holder plate 16 is made to be larger than the height of the protrusion section 28 in the cover plate 18, thereby forming a spacing S of a certain thickness between the depression section 24 and the protrusion section 28. The holder plate 16 has a large number of flow holes 38 formed vertically through the plate 16, and they are communicated with a fluid hole 40 in the fixing plate 20 by way of the space S formed between the cover plate 18 and the holder plate 16. The flow holes 38 are communicated with the back surface of the workpiece held on the front surface of the holder plate 16. The space S, as described in more detail later, is for retaining a back side pressure therein, and when it is connected to an evacuation device, it produces a suction force, and when it is connected to a pressure fluid source, it produces a pressing force.

The drive shaft 12 is supported by top ring head section 42, which is fixed to the polishing apparatus, so as to be freely rotatable and vertically movable, and is coupled to an output shaft of the drive source (motor with reduction gears, not shown) through a pulley belt device 44. The vertical movement is produced by the action of a piston rod 48*a* in top ring cylinder 48 disposed between the top ring head section 42 and drive shaft holder 46 (refer to FIG. 2). Specifically, the main body of the top ring cylinder 48 is fixed to a shoulder section of the drive shaft holder 46, and the tip of the piston rod 48*a* is fixed to the lower surface of the top ring head section 42.

The drive shaft 12 is formed as a hollow member, and a through hole 50 formed in its center section is communicated with an external pressure source apparatus 54 via a rotary joint 52. A corrosion resistant fluid tube 56, made of a polymeric resin such as Teflon or polypropylene, is inserted inside the through hole 50. The top end of the fluid tube 56 is connected to rotary joint 52 and the bottom end thereof is divided into separate tubes 56*a*, 56*b* (FIG. 3) which are connected to fluid holes 40 in the fixing plate 20. In this design, the pressure fluid is supplied through the rotary joint 52 to the top end of the through hole 50 so that there is no need to provide a horizontal hole on the lateral side of the drive shaft 12, thus resulting in a simplified construction and a lower production cost.

The external pressure source apparatus 54, in this embodiment, is provided with an evacuation device 58, a pressurized air source 60 and pure water supply source 62, each of which can be selectively connected to the flow holes 38 in the holder plate 16 through selection valves 64*a*, 64*b*, 64*c*, rotary joint 52, delivery tubes 56, 56*a* and 56*b*. A polishing solution supply nozzle (not shown) is disposed above the turntable to enable a polishing solution to be supplied to the surface of the polishing cloth on the turntable.

A driver plate 68 having an outwardly extending flange or flange section 66 is fixed to the bottom end of the drive shaft 12. The universal joint 14 is provided between the driver plate 68 and the cover plate 18 of the top ring member 10 for tiltably supporting the top ring member 10 and transmitting the pressing force thereto. The universal joint 14 has a spherical bearing mechanism 70 and a rotation transmission mechanism 72 for transmitting the rotational force of the drive shaft 12 to the top ring member 10.

The spherical bearing mechanism 70 will be explained first. In the center of the front surface of the driver plate 68, there is a protruded area 76 formed in such a way that the lower surface makes a gentle spherical surface, and in the center of this protruded area 76, there is a spherical cavity 80 for freely slidingly retaining a bearing ball 78 made of a high hardness material such as ceramics. The depressed area 32 in the center of the upper surface of the cover plate 18 has width and depth dimensions sufficient to house the protruded area 76 of the driver plate 68, and in the center of the depressed area 32, there is also a spherical cavity 82 to pair with the spherical cavity 80 to contain the bearing ball 78. The bottom end of the bearing ball 78 is positioned inside the depression section 24 of the holder plate 16, i.e., below the level of the step surface 26.

By forming the depression section 24 in the holder plate and the protruded area 76 in the cover plate 18 so as to make the top ring thin, and by locating at least a part of the spherical bearing unit within the depression section 24 of the holder plate 16, it becomes possible to bring the spherical bearing unit close to the turntable. The distance L between the center of the bearing ball 78 and the front surface of the holder plate 16 is designed to be less than 26 mm.

Figure 3:
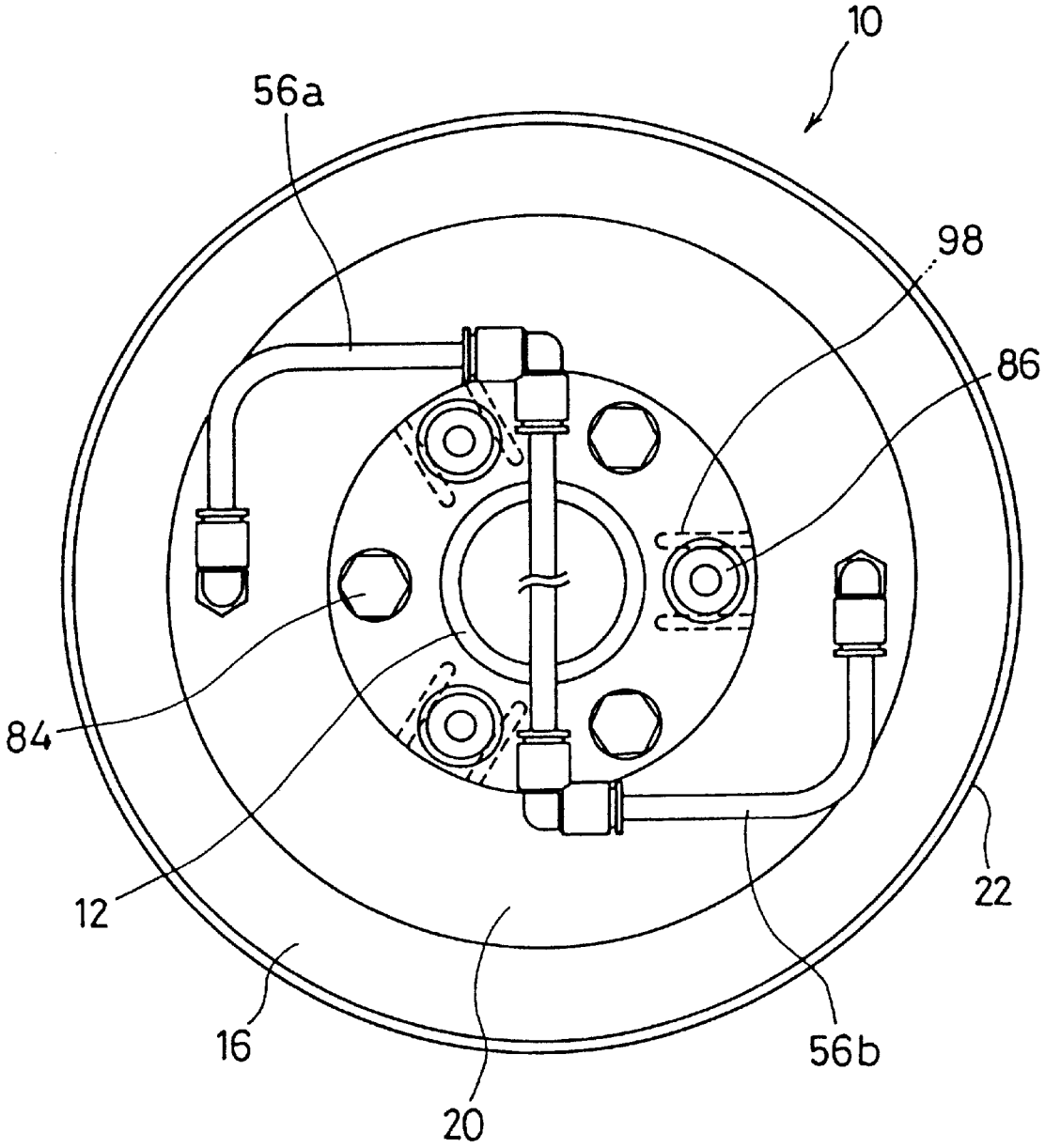
FIG. 3 is a plan view of the essential parts of the apparatus shown in FIG. 1.
Figure 4:
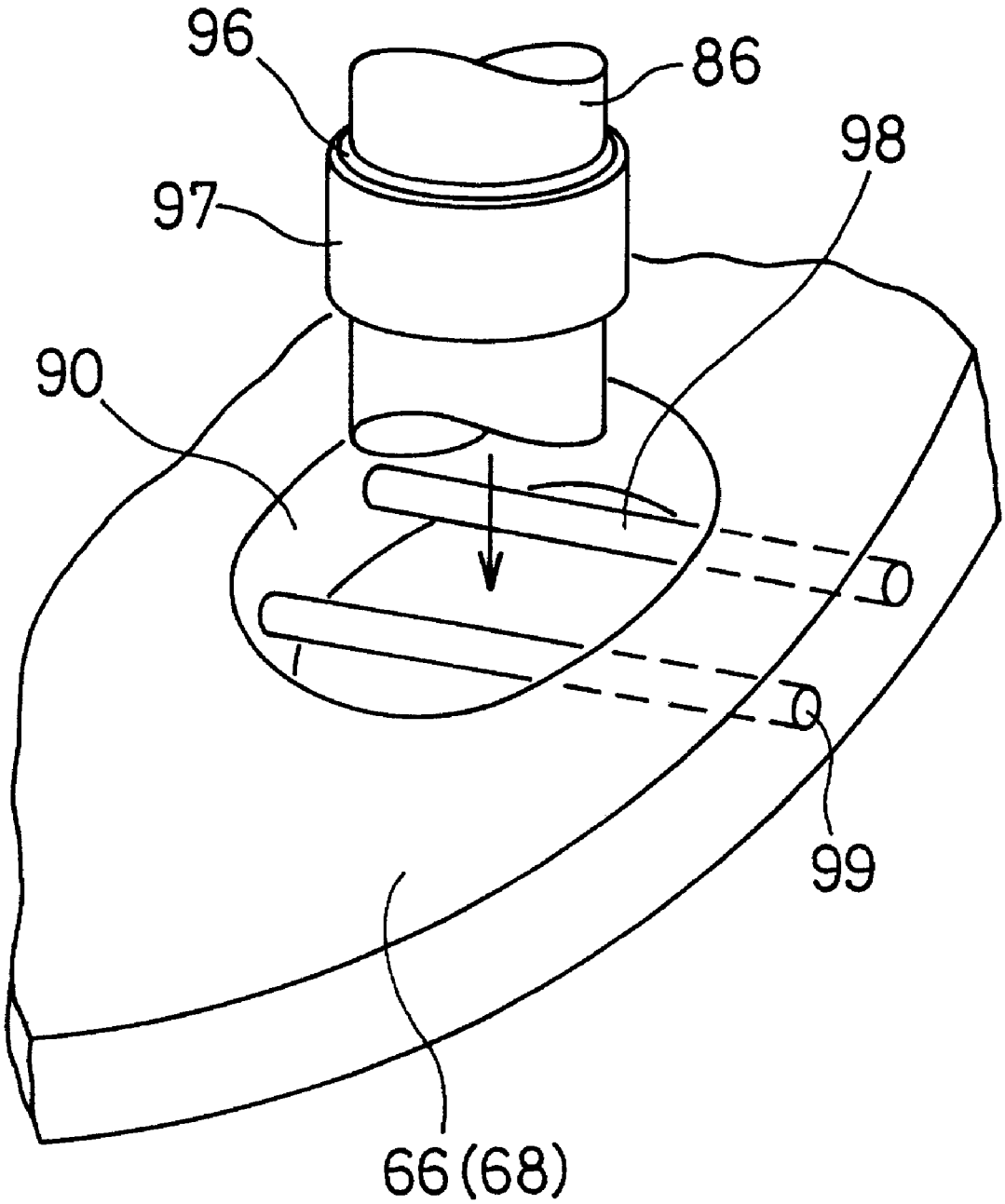
FIG. 4 is a perspective view of the embodiment shown in FIG. 1.
Figure 5:
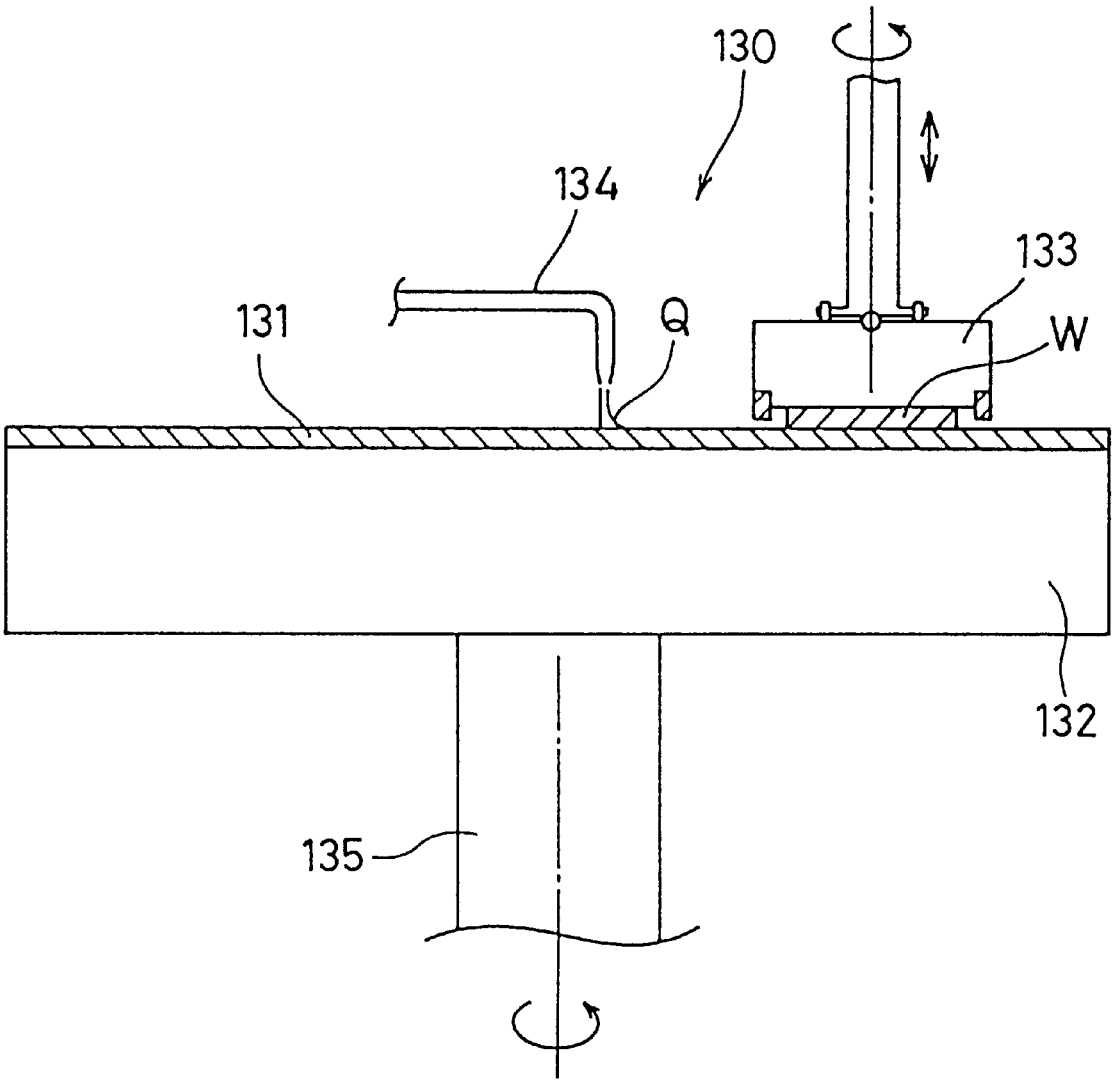
FIG. 5 PRIOR ART
FIG. 5 is a schematic cross sectional view of a conventional polishing apparatus.
Figure 6:
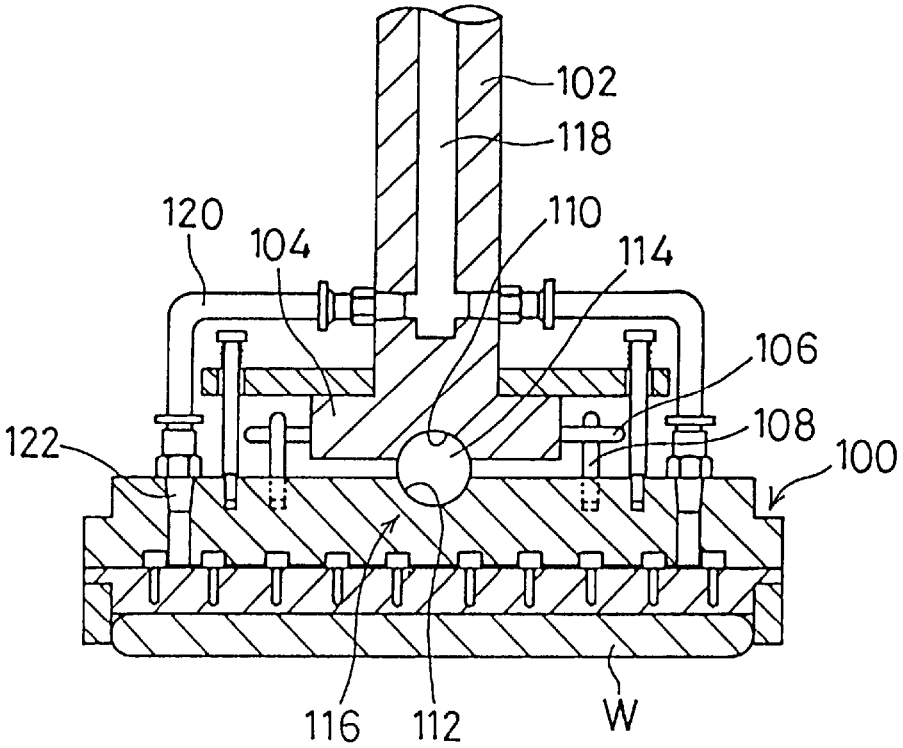
FIG. 6 PRIOR ART
FIG. 6 is a cross sectional view of a top ring in the conventional polishing apparatus.
Figure 7:
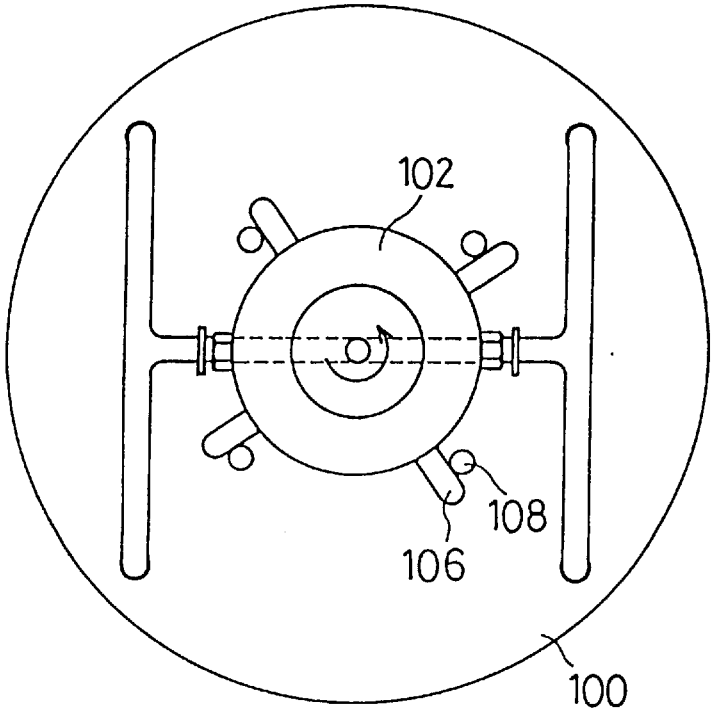
FIG. 7 PRIOR ART
FIG. 7 is a plan view of the apparatus shown in FIG. 6.

As shown in FIGS. 1, 3 and 4, the shoulder section 34 protruding around the depressed area 32 of the cover plate 18 is provided with several pins 84, 86 (six in this embodiment) spaced at equal angles, which are inserted into respective holes 88, 90 provided at corresponding locations in the flange section 66 of the driver plate 68. These pins 84, 86 are distributed such that suspending pins 84 for suspending the top ring member 10 and driven pins 86 for transmitting the torque to the top ring member 10 are placed alternately. The suspending pins 84 are protruded out of the upper surface of the driver plate 68, and a spring 94 is placed between a stopper plate 92 disposed at the top end of the pin and the driver plate 68 so as to support (a part of) the load exerted by the top ring member 10 with the elastic force of the spring 94.

With reference to FIGS. 3 and 4, two parallel driver pins 98 are horizontally embedded in holes 90 of the driver plate 68 on opposite circumferential sides of the driven pins 86. That is, as shown in FIG. 4, two fine holes 99 are provided in such a way to open at a side surface of the flange section 66 and into hole 90 located on the flange section 66 of the driver plate 68, and the driver pins 98 are inserted and fixed in these fine holes 99.

As illustrated in FIG. 4, the driven pin 86 is provided with a cushion 96, made of an elastic material such as rubber, around the periphery, and each cushion 96 has a cushion cover 97 on its periphery. Each driver pin 98 touches the outer periphery of the cushion cover 97. The rotation transmission mechanism 72 thus comprises the driver pins 98 and the driven pins 86 to transmit the torque smoothly and with certainty from the drive shaft 12 to the top ring member 10.

Next, the operation of the polishing apparatus having the construction presented above will be explained.

By connecting the evacuation device 58 of the external pressure source apparatus 54 to the rotary joint 52, the workpiece is held on the lower surface of the holder plate 16 by the suction at the flow holes 38 in the holder plate 16, and drive power is applied to the drive shaft 12 to rotate the holder plate 16. In this case, because the fluid tube 56 is made of Teflon or polypropylene, it is sufficiently strong so as not to collapse under the stress of evacuation.

Figure 2:
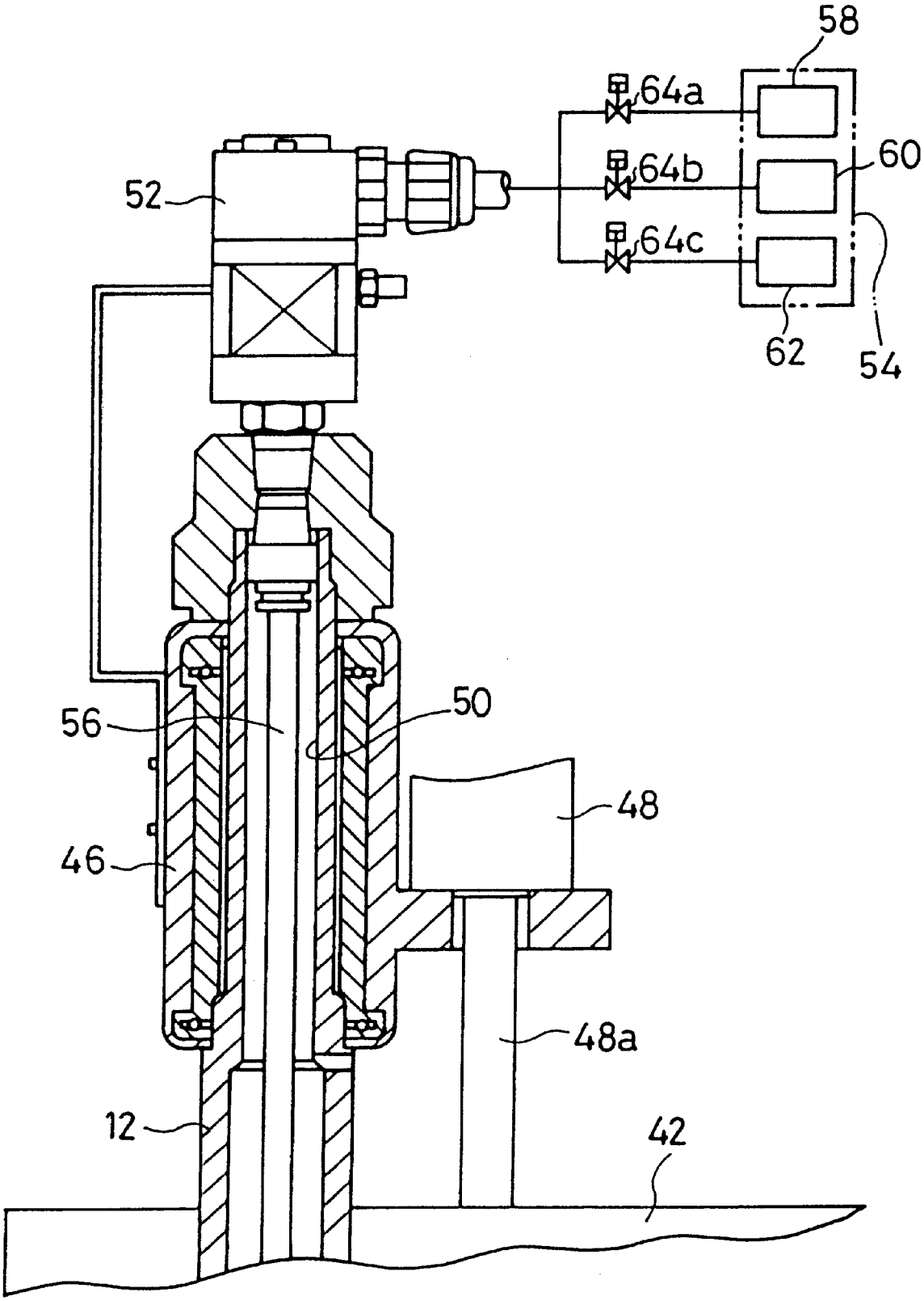
FIG. 2 is a cross sectional view of the upper section of the apparatus shown in FIG. 1.

With reference to FIG. 2, the top ring cylinder 48 is operated so that the piston rod 48*a* is pulled into the top ring cylinder 48, then, because the top ring head 42 is fixed to the polishing apparatus frame, the top ring cylinder 48 is descended together with the drive shaft holder 46. The workpiece is made to touch the turntable first, and then, it is further pressed against the turntable. The pulling force exerted by the piston rod 48*a* is transmitted to the workpiece in the form of a pressing force by way of the drive shaft 12, bearing ball 78, flange section 30 of the cover plate 18 and the holder plate 16. The workpiece is thus pressed onto the polishing cloth on the turntable with a given pressure. In the meantime, when the top ring member 10 begins to descend, the turntable rotation had already been started and the polishing solution is being supplied through the supply nozzle onto the polishing cloth on the turntable. The surface to be polished (bottom surface) of the workpiece is polished under the existence of the polishing solution so that the polishing process is commenced.

In this polishing operation, because the pressing force from the drive shaft 12 is transmitted through the spherical bearing 70 provided between the drive shaft 12 and the top ring member 10, even if the vertical alignment of the drive shaft 12 to the cloth surface of the turntable is impaired, for example, the holder plate 16 can tilt about a center at the bearing ball 78 so that the workpiece is kept in close contact with the cloth surface.

Also, because the depression section 24 and the protrusion section 28 are formed to mate with each other in an opposing manner on the respective holder plate 16 and the cover plate 18, the thickness of the center region of the holder plate 16 is reduced. Also, because a part of the spherical bearing structure resides within the depression section 24, the distance between the center of the spherical bearing 70 and the workpiece surface is made short. Therefore, the rotational moment about the spherical bearing 70 is also reduced so that the attitude of the workpiece is stabilized. The result is that stable polishing can be carried out without sacrificing the stiffness of the holder plate while maintaining all the essential polishing requirements, such as securing the space necessary for supplying the polishing solution to the top ring member 10 and keeping the workpiece in close contact with the polishing cloth on the turntable.

Furthermore, the distance between the center of the spherical bearing 70 and the workpiece surface is also made short because the bearing ball 78 is provided between the depressed area 32 in the cover plate 18 and the protruded area 76 provided at the bottom end of the drive shaft 12, which also promotes a stable alignment of the workpiece. Further, the peripheral section of the top ring member 10 has been given a sufficient thickness to provide the shoulder section 34 and the step surface 36, so as not to sacrifice either the stiffness or the space required for fabricating the connection hole 40 or implanting the driven pins 86.

In this design of the workpiece holder device, even if the holder plate 16 becomes tilted, the driven pins 86 and the driver pins 98 are relatively movable in the vertical direction so that the rotational torque of the drive shaft 12 is reliably transmitted to the holder plate 16 by simply relocating the contacting points to each other. Also, because the driven pins 86 and the driver pins 98 are in point contact at right angles to each other, friction is low and the freedom of tilting is maintained.

In this embodiment, each driven pin 86 is surrounded with an elastic cushion 96 such as rubber to absorb vibration between the drive shaft and the top ring. Further, the outer surface of the cushion 96 is covered with a tube shaped cushion cover 97, and the driver pins 98 contact the cushion cover 97 at opposite peripheral sides. Therefore, the driven pins 86 and the driver plate 68 are able to freely move vertically relative to each other while maintaining an elastic contact.

Also, the bottom end surface of the protruded area 76 of the driver plate 68 is formed as a spherical surface (flank) 74 of a large radius of curvature, so that the separation distance from the top surface of the cover plate 18 progressively increases from the center towards the circumference, therefore, even if the spherical cavity 82 is made sufficiently large, there is no mechanical interference between the curved surface 74 and the depressed area 32, so that the pressing force is transmitted reliably from the drive shaft 12 to the bearing ball 78.

To assure reliable contact of the workpiece to the polishing cloth, the fluid tube 56 may be switched to air pressure source 60 so that compressed air may be supplied to the back surface of the workpiece through the flow holes 38 and the spacing S.

When the polishing operation is completed, the drive shaft 12 is raised, and the drive plate 68 integral with the drive shaft 12 is also raised, and the cover plate 18 and the top ring member 10 are elastically supported approximately horizontally by way of the springs 94 and the suspending pins 84. In this state, the top ring member 10 is retracted away from the turntable, and is operated the pressure source apparatus 54 as needed to hold/detach the workpiece from the top ring member 10 to handle the workpiece between the top ring member 10 and some external device.

By connecting the evacuation device 58 of the external pressure source apparatus 54 to the rotary joint 52, the workpiece is held on the lower surface of the holder plate 16, and by connecting the pure water supply source 62 of the external pressure source apparatus 54 to the rotary joint 52, pure water is made to flow through the fluid tube 56, space S, and the flow holes 38 in the holder plate 16 to push the back surface of the workpiece to detach the workpiece readily from the holder plate 16.

In this embodiment, because the holder device is designed so that the pressing force is transmitted from the flange section 30 of the cover plate 18 to the step surface 26 of the holder plate 16, a uniform pressure can be applied to the holder plate 16 on the total surface of the workpiece, compared with the conventional arrangement in which the pressure is applied through the center of the holder plate through the bearing ball, because the forces are distributed around the periphery of the holder plate 16 to reduce the amount of deflection of the holder plate 16.

In the present polishing apparatus, the fluid tube 56 is made of a corrosion resistant material, therefore, even when water or air is supplied through the through hole, no rust is formed on its interior. Contamination is thus prevented, and polishing precision as well as the final quality of the polished workpiece can be improved.

Also, in the present embodiment, the driver section and the driven section to transmit the rotational torque from the drive shaft 12 to the holder plate 16 are based on pin contacts. However, the invention is not necessarily limited to such designs. Other possible designs such as plate form and other special forms are also employable. Also, the driver pins 98 to engage the driven pin 86 are disposed parallel in the present embodiment, but they may not be parallel, nor be limited to two pins. Conversely, for example, driver pins may be protruded from the side of a plate 68 and several driven pins may be provided on the top surface of the driven plate 18 so as to hold the driver pin. Also, in the present embodiment, the drive shaft 12 has a separate fixed driver plate 68, but the drive plate 68 may be formed integrally with the drive shaft 12.

What is claimed is:

1. A polishing apparatus for producing a mirror finish on a workpiece and including a polishing tool and a workpiece holding device, said device comprising:

a top ring member comprising:

a holder plate having a front surface for holding a workpiece and a back surface having a depression section; and a cover plate having a front surface having a protrusion section engaging with said depression section and a back surface;

a drive shaft supporting said top ring member and enabling transmission of a pressing force to said top ring member; and a curved surface bearing unit, provided between an end portion of said drive shaft and said back surface of said cover plate, for coupling said drive shaft and said top ring member while permitting tilting motion of said top ring member relative to a polishing surface of the polishing tool, said unit comprising a spherical bearing including a ball having an entirely spherical configuration, at least a portion of said ball being located at a level within said depression section.

2. An apparatus as claimed in claim 1, further comprising a transmission device for transmitting rotation of said drive shaft to said top ring member.

3. An apparatus as claimed in claim 1, wherein said ball is made of a high hardness material.

4. An apparatus as claimed in claim 1, wherein said back surface of said cover plate has a depressed area, and said curved surface bearing unit extends into said depressed area.

5. A polishing apparatus for producing a mirror finish on a workpiece and including a polishing tool and a workpiece holding device, said device comprising:

a top ring member for holding a workpiece;

a drive shaft supporting said top ring member;

a curved surface bearing unit between said drive shaft and said top ring member to enable tilting of said top ring member; and a force transmission mechanism between said drive shaft and said top ring member for transmitting a rotational force from said drive shaft to said top ring member, said mechanism comprising:

a drive member extending from said drive shaft;

a driven member extending from said top ring member; and said drive member and said driven member being positioned to engage each other upon rotation of said drive shaft, with at least one of said drive member and said driven member being positioned to contact the other said member from two sides in a circumferential direction, thereby restricting relative circumferential movement of said top ring member with respect to said drive shaft.

6. An apparatus as claimed in claim 5, wherein all contact between said drive member and said driven member is point contact.

7. An apparatus as claimed in claim 5, further comprising an elastic cushioning medium between said drive member and said driven member.

8. An apparatus as claimed in claim 5, wherein said one member is embedded in a hole into which said other member loosely fits.

9. A polishing apparatus for producing a mirror finish on a workpiece and including a polishing tool and a workpiece holding device, said device comprising:

a top ring member for holding a workpiece with a space therebetween;

a drive shaft supporting said top ring member, said drive shaft having a central region having therein a hole;

a curved surface bearing unit between said drive shaft and said top ring member to enable tilting of said top ring member; and a force transmission mechanism between said drive shaft and said top ring member for transmitting a rotational force from said drive shaft to said top ring member; and a fluid tube extending through said hole, said fluid tube having one end to be connected to a fluid supply source and an opposite end to communicate with the space.

10. An apparatus as claimed in claim 9, wherein said fluid tube is made of a corrosion resistant material.

11. An apparatus as claimed in claim 9, wherein said fluid tube is made of a flexible material.

12. A workpiece holding device for use with a polishing tool, said device comprising:

a top ring member comprising:

a holder plate having a front surface for holding a workpiece and a back surface having a depression section; and a cover plate having a front surface having a protrusion section engaging with said depression section and a back surface;

a drive shaft supporting said top ring member and enabling transmission of a pressing force to said top ring member; and a curved surface bearing unit, provided between an end portion of said drive shaft and said back surface of said cover plate, for coupling said drive shaft and said top ring member while permitting tilting motion of said top ring member relative to a polishing surface of the polishing tool, said unit comprising a spherical bearing including a ball having an entirely spherical configuration, at least a portion of said ball being located at a level within said depression section.

13. A device as claimed in claim 12, further comprising a transmission device for transmitting rotation of said drive shaft to said top ring member.

14. A device as claimed in claim 12, wherein said ball is made of a high hardness material.

15. A device as claimed in claim 12, wherein said back surface of said cover plate has a depressed area, and said curved surface bearing unit extends into said depressed area.

16. A workpiece holding device comprising:

a top ring member for holding a workpiece;

a drive shaft supporting said top ring member;

a curved surface bearing unit between said drive shaft and said top ring member to enable tilting of said top ring member; and a force transmission mechanism between said drive shaft and said top ring member for transmitting a rotational force from said drive shaft to said top ring member, said mechanism comprising:

a drive member extending from said drive shaft;

a driven member extending from said top ring member; and said drive member and said driven member being positioned to engage each other upon rotation of said drive shaft, with at least one of said drive member and said driven member being positioned to contact the other said member from two sides in a circumferential direction, thereby restricting relative circumferential movement of said top ring member with respect to said drive shaft.

17. A device as claimed in claim 16, wherein all contact between said drive member and said driven member is point contact.

18. A device as claimed in claim 16, further comprising an elastic cushioning medium between said drive member and said driven member.

19. A device as claimed in claim 16, wherein said one member is embedded in a hole into which said other member loosely fits.

20. A workpiece holding device comprising:

a top ring member for holding a workpiece with a space therebetween;

a drive shaft supporting said top ring member, said drive shaft having a central region having therein a hole;

a curved surface bearing unit between said drive shaft and said top ring member to enable tilting of said top ring member; and a force transmission mechanism between said drive shaft and said top ring member for transmitting a rotational force from said drive shaft to said top ring member; and a fluid tube extending through said hole, said fluid tube having one end to be connected to a fluid supply source and an opposite end to communicate with the space.

21. A device as claimed in claim 20, wherein said fluid tube is made of a corrosion resistant material.

22. A device as claimed in claim 20, wherein said fluid tube is made of a flexible material.

* * * * *